United States Patent [19]

Regan et al.

[11] 4,178,992

[45] Dec. 18, 1979

[54] METAL SEAL TUBING PLUG

[75] Inventors: Louis M. Regan, Beaumont, Calif.; Thomas W. Childers, Mandeville, La.; Roy E. Anderson; Joseph A. Burkhardt, both of New Orleans, La.

[73] Assignee: Exxon Production Research Company, Houston, Tex.

[21] Appl. No.: 873,304

[22] Filed: Jan. 30, 1978

[51] Int. Cl.[2] ..... E21B 7/06

[52] U.S. Cl. ..... 166/117.6

[58] Field of Search ..... 166/209, 117.6, 118

[56] References Cited

U.S. PATENT DOCUMENTS

| | | | |
|---|---|---|---|
| 3,115,935 | 12/1963 | Hooton | 166/117.6 |
| 3,610,336 | 4/1970 | Sizer | 166/117.6 |

*Primary Examiner*—Robert I. Smith

*Attorney, Agent, or Firm*—John S. Schneider

[57] ABSTRACT

A metal seal plug for use in sealing a tubing run is disclosed. The plug includes upper and lower tubular housings connected together for limited movement therebetween by an inner mandrel. The lower housing contains a locking unit which when actuated locks into a recess formed in the tubing to lock the plug in the tubing. The upper housing contains an actuator for actuating the locking unit when the upper housing is forced down with respect to the lower housing. The lower housing also contains a metal seal ring which engages metal sealing surfaces on the tubing and on the lower housing to seal off the space between the plug and the tubing. The distance between the locking unit and the metal seal ring and the distance between the recess and the sealing surface on the tubing run are selected to ensure that the metal seal ring is properly loaded when the plug is locked in the tubing. Initially, shearable means releasably secures the mandrel to the upper tubular member to prevent movement between the upper and lower housings. The lower end of the plug may be a closed nose member or a diverter to be positioned in a curved tubing run of a Y-spool.

10 Claims, 8 Drawing Figures

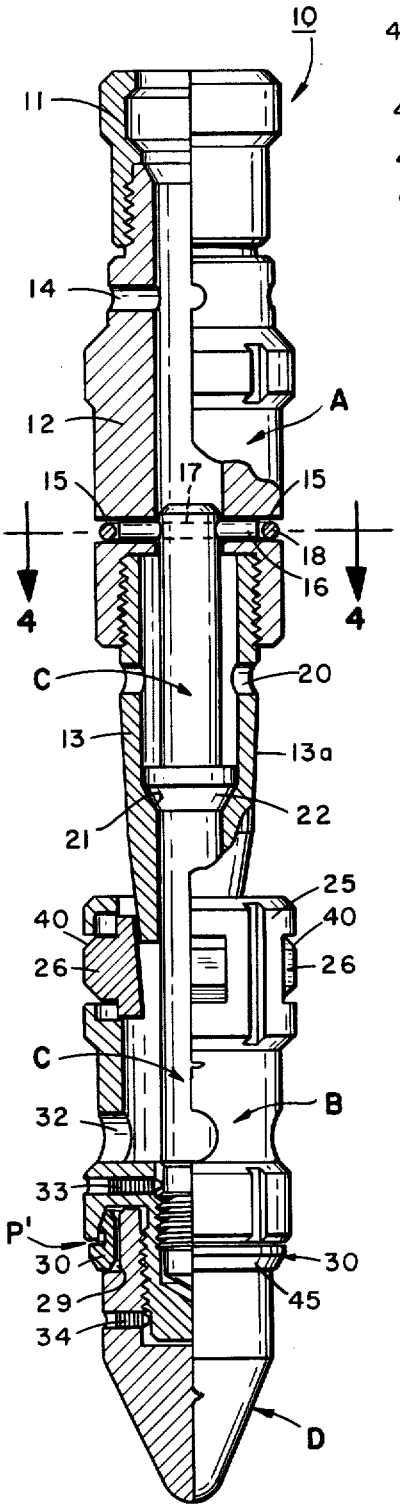
FIG. 1.
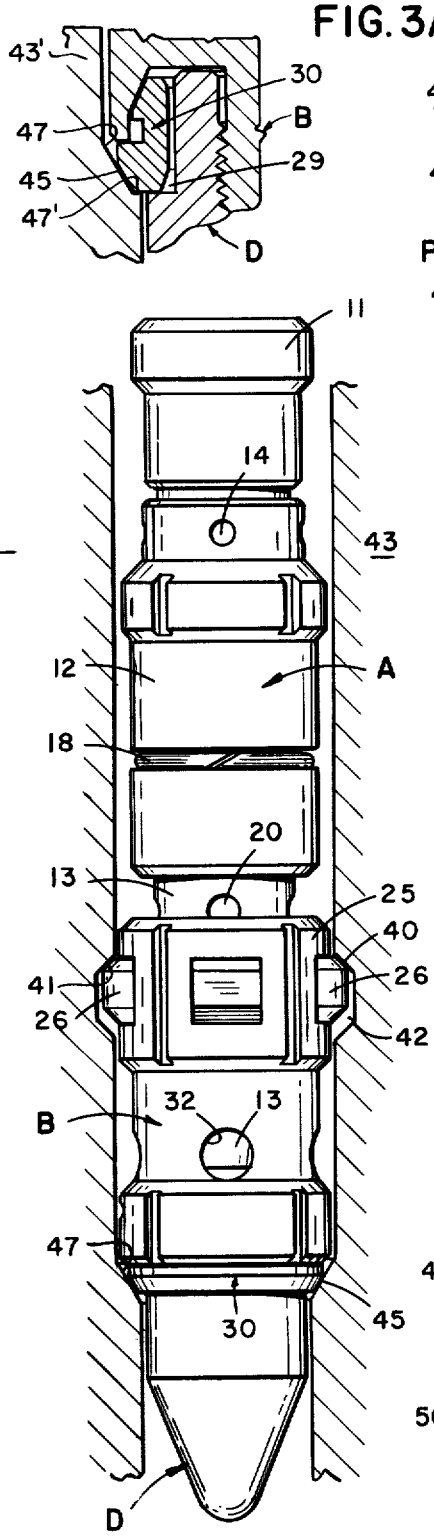
FIG. 2.
FIG. 3A.
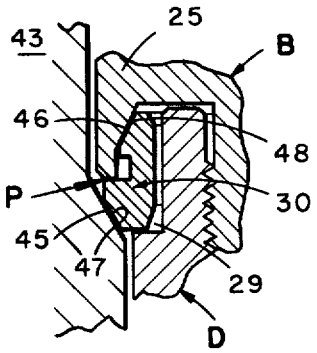
FIG. 3.
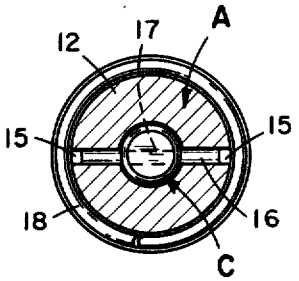
FIG. 4.
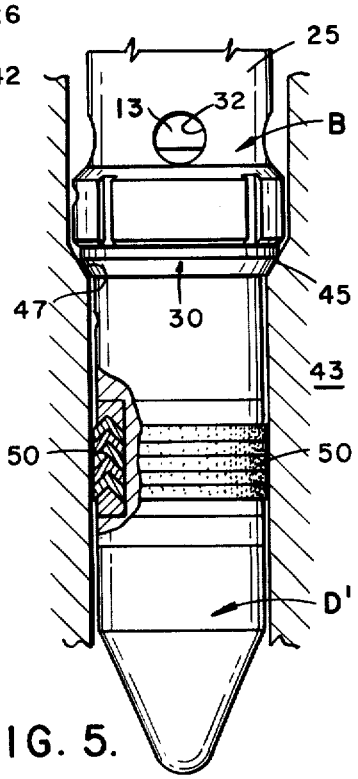
FIG. 5.

METAL SEAL TUBING PLUG

BACKGROUND OF THE INVENTION

The present invention concerns a metal seal plug and, particularly, a metal seal plug for use in sealing off a tubing run in an underwater oil and/or gas well system.

The improved plug of the present invention utilizes a metal-to-metal seal which provides a reliable, wire line or tubing installable and retrievable, plug for subsea tubings. A metal-to-metal type seal has superior seal reliability over conventional, resilient, elastomer type seals. Materials chosen for the metal seals are less susceptible to failure and resultant leaks than available elastomer materials. Elastomer seal systems are susceptible to deterioration due to age, gas infusion, cold flow or creep. When used in subsea christmas trees the improved plug is run after completion work has been accomplished and before the completion riser is retrieved. When employed in this manner, the plug is less costly and provides a more reliable pressure seal and a more reliable means of closing and opening tubings than hydraulically actuated valves or plugs which use only resilient seals.

SUMMARY OF THE INVENTION

In accordance with the teachings of the invention, a plug for use in sealing a tubing run includes first and second housings and an inner mandrel connecting the two housings together for limited movement therebetween. Locking means on the first and second housings cooperate to lock the plug in a recess formed in the tubing when the first housing is moved relative to the second housing. The second housing contains metal seal means which engages and seals on metal sealing surfaces on the tubing and on the second housing to seal off the annulus between the tubing and the plug when the locking means is locked in the recess of the tubing. The distance between the locking means and the metal seal means and the distance between the recess and the metal sealing surface on the tubing are selected to ensure that the metal seal means is properly loaded when the plug is locked in the tubing.

BRIEF DESCRIPTION OF THE DRAWINGS

FIG. 1 is partly sectional view of one embodiment of the plug of the invention;

FIG. 2 is a view of the plug of FIG. 1 in sealing position in a tubing;

FIG. 3 is an enlarged view of the seal ring of FIGS. 1 and 2 in sealing position and FIG. 3A is a similar view illustrating a modified sealing surface;

FIG. 4 is a view taken along lines 4—4 of FIG. 1;

FIG. 5 is a view of a modified plug;

DESCRIPTION OF THE PREFERRED EMBODIMENTS

Figure 6:
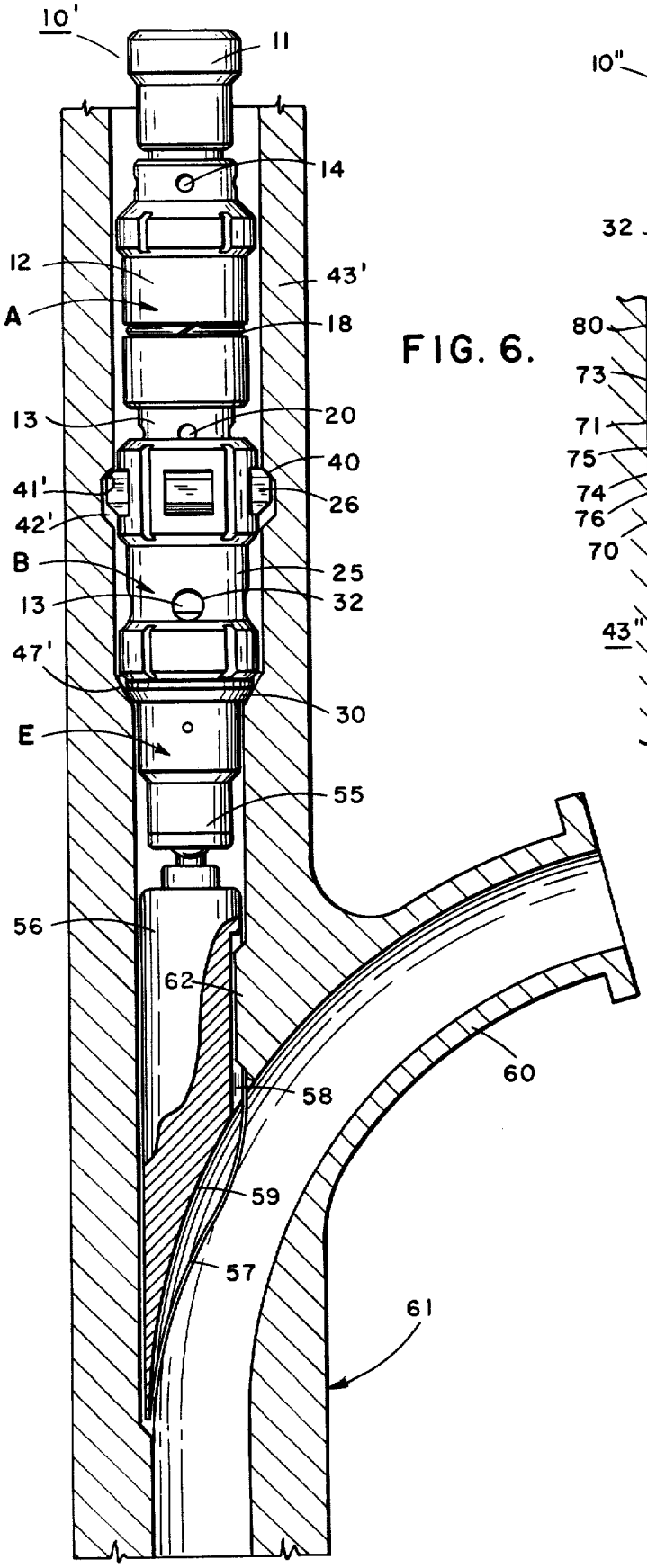
FIG. 6 is a view partly in section of another modification of the plug in sealing position in a tubing.

There is shown in FIG. 1 a tubing plug assembly, generally designated 10, which includes an upper tubular housing A, a lower tubular housing B, an inner mandrel C and a lower closed nose end member D. Upper housing A contains a wire line running and retrieving neck 11 threaded to a body member 12 which is, in turn, threaded to a conically shaped member 13 having a locking taper indicated at 13a. Body member 12 contains fluid flow passageways 14 and opposed openings 15 in which a shear pin 16 is located. Shear pin 16 extends through an opening 17 in mandrel C as also shown in FIG. 4. A shear pin retainer ring 18 is located in a groove formed in body member 12. Cone-shaped member 13 contains fluid flow passageways 20 and an inner retainer shoulder 21 which engages and supports an enlarged shoulder 22 formed on mandrel C. Lower housing B contains a locking unit 25 which is provided with expansible-retractable locking lugs or dogs 26. Nose end member D is threaded to locking unit 25 and forms therewith an annular recess 29 in which is positioned an annular crescent-shaped metal seal member 30. Locking unit 25 also contains fluid flow passageways 32. Set screw 33 retains mandrel C threaded to lower housing B and set screw 34 retains locking unit 25 threaded to nose member D. Passageways 14, 20 and 32 are provided to prevent trapping of liquid within the plug.

As also shown in FIG. 2, locking dogs 26 are each formed with a tapered upper surface 40 which wedges against a mating tapered locking recess shoulder surface 41 of locking recess 42 formed on the inner wall of a tubing run 43. As shown in FIG. 3, annular seal member 30 is provided with tapered sealing surfaces 45 and 46 which mate with and seal against, respectively, a special tapered receiver seal shoulder surface 47 formed on the inner wall of tubing run 43 and a tapered sealing surface 48 formed on locking unit 25 in recess 29. The spacings or distances between surfaces 41 and 47 of tubing run 43 and surfaces 40 and 45 of plug 10 are precisely selected so that seal member 30 is properly loaded for sealing purposes when plug 10 is locked in its actuated position. FIG. 3A shows a modification of the receiver seal surface 47 which provides a stop ledge 47' which serves to limit the travel of seal member 30. The position of this ledge with respect to locking recess shoulder 41 is dimensionally controlled to enable application of the desired preload in the plug body and seal to prevent movement of the plug when test pressure is applied from above the plug.

In FIG. 5, a modified nose end member D' contains an elastomer, chevron type packing 50, which is arranged in the smaller bore of tubing run 43 below sealing surface 47 and seals off the annulus between end member D' and tubing 43 against upward, but not downward, flow.

In FIG. 6 another modification of the plug shown in FIGS. 1 and 2 is illustrated. All of the components are the same as in FIGS. 1 and 2 expect in place of nose end member D a diverter unit E is threadedly connected to sealing unit 25. Unit E includes a swivel, indicated at 55, attached to a diverter 56 which is provided with an orienting profile 57. The upper portion of profile 57 terminates in a vertical slot 58. Diverter 56 contains a shaped end 59 which when in proper position, as shown, conforms to the curved contour of a curved tubing run 60 which forms part of an underwater oil and/or gas production christmas tree, generally designated 61. Vertical tubing run 43' directly connects into curved tubing run 60. Tubing 43' is provided with a recess 42' similar to recess 42 of FIG. 2 and a shoulder sealing surface 47' similar to shoulder 47 of FIGS. 2 and 3 and an orienting key 62.

Figure 7:
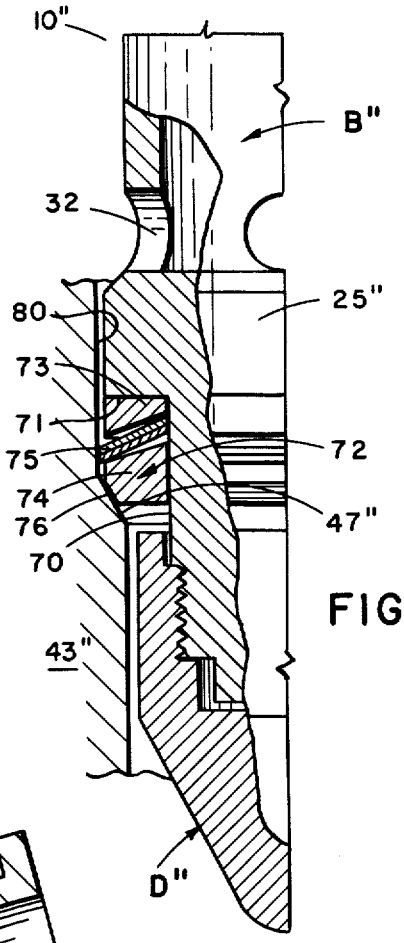
FIG. 7 is a sectional view of a modified seal ring for the plug.

Referring now to FIG. 7 there is shown a locking unit 25'' having a lower recess formed by a reduced diameter wall 70 and an upper shoulder 71. A nose end member D" is threaded to the lower end of locking unit 25". Wall 70 is preferably polished and provides a sealing surface for a conically shaped metal seal ring assembly, generally designated 72, arranged about wall 70 between shoulder 71 and the upper end of nose end member D". Assembly 72 includes two spacer rings 73 and 74 between which are positioned two conically shaped metal seal rings 75. In unloaded position the outer edges or peripheries of rings 75 align with the outer peripheries of spacer rings 73 and 74. When loaded as shown in FIG. 7 rings 75 are compressed to seal at the inner wall sealing surface 80 of tubing run 43" and at wall 70 of unit 25". Spacer ring 74 is tapered at 76 to conform to the taper of shoulder surface 47" upon which spacer ring 74 seats.

OPERATION

Plug 10 is run into and retrieved from tubing 43 in accordance with techniques which are well known in the art. When installing plug 10 to seal tubing run 43, neck 11 of plug 10 is connected to a running tool and jars and lowered on a wire line or tubing through tubing 43, with the components of plug 10 positioned as shown in FIG. 1, i.e. with housing A immovable relative to housing B, until seal surface 45 on annular seal 30 lands on shoulder 47 of tubing 43. Plug 10 is then jarred down to shear pin 16 and force actuator cone 13 down and force locking dogs 26 into recess 42 and wedge mating surfaces 40 and 41 together. As shown in FIG. 3 the surface of ring 30 and the surface of locking unit 25, as indicated at P, make up face-to-face when ring 30 is in sealing position in tubing run 43. To achieve a desired preload on seal ring 30 within the dimensional confines of plug 10, nose member D is tightened prior to running plug 10 into tubing 43 until the upper seal surface 46 of ring 30 is energized and pressed tightly against tapered sealing surface 48 of locking unit 25. After preloading but before placing plug 10 in sealing position in tubing run 43 the surfaces of ring 30 and locking unit 25 are, preferably, spaced apart about 0.010 to 0.015 inches as indicated at P' in FIG. 1. Such preloading minimizes vertical travel of plug 10 and precisely sets the spacing dimension between tapered sealing surface 45 of ring 30 and tapered surface 40 of locking dogs 26 in housing 25. Locking dogs 26 engage the upper tapered surface 41 of the locking recess and as the dogs are expanded by mandrel cone 13a the dogs impart a downward force on plug 10. This downward force along with the resultant downward impact of the jarring action of the setting tool sets the gasket with a high residual strain. Additional downward jarring of plug 10 puts the desired load on the surface 45 of ring 30 against tapered surface 47 of tubing run 43 ensuring a fluid tight seal between plug 10 and surface 47 of tubing run 43. Locking taper 13a of cone 13 ensures maintenance of a fluid tight seal. The cone shaped locking mandrel 13a is tapered such that the setting forces are locked into the plug by friction between the mandrel and the dogs. The mechanical energization coupled with the pressure energized design of the gasket makes the seal system comparable to that used in flanged type connections. Fluid pressure may then be applied to the tubing run above plug 10 to test the seal. The jars and running tool are then disconnected from neck 11 and retrieved in a manner known to the art.

When it is desired to retrieve plug 10 a retrieving tool and jars are run in tubing 43 on a wire line or tubing and the retrieving tool is latched onto neck 11. The plug is then jarred upward until actuator cone 13 moves up which releases dogs 26 and permits them to retract allowing plug 10 to be retrieved.

The additional elastomer seal 50 shown in FIG. 5 prevents upward flow around plug 10 through tubing 43 but allows downward flow from above plug 10 when testing metal seal 30. Seal 50 may be used to back up metal seal 30 in the event seating surface 47 is damaged and will not permit a seal to be effected.

Installation and retrieval of plug 10', shown in FIG. 6, are conducted similarly to installation and retrieval of plug 10 of FIGS. 1 through 4. Plug 10' is lowered along with a running tool and jars on a wire line or tubing through tubing 43' until orienting contour 57 of diverter 56 engages orienting key 62 causing the diverter to rotate until vertical slot 58 is aligned on key 62. When seal ring 30 engages sealing surface 47' the curved surface 59 of diverter 56 is properly aligned with the bore of curved tubing 60. The locking unit 25 is then jarred into position forcing sealing surface 45 against sealing surface 47' and sealing surface 46 against sealing surface 48 to load adequately and properly annular ring seal 30. Surface 46 may be pressed tightly against sealing surface 48 to achieve a desired preload on seal ring 30 by tightening diverter unit E on housing B prior to running plug 10' in tubing 43'. The shape of diverter end 58 is such that the curved tubing 60 is smooth on the outer bore of the flow path therethrough when the diverter is properly in place as shown. Plug 10' and diverter 56 of FIG. 6 are released by jarring up and are retrieved in the same manner as described above with respect to the retrieval of plug 10.

The running and setting operation of plug 10" of FIG. 7 is similar to the previously described operation for FIGS. 1 through 4. When in the lowering-in position metal seal rings 75 are contracted and spacer ring 73 abuts shoulder 71 and spacer ring 74 abuts the top of nose member D". The tapered surface 76 of lower spacer ring 74 contacts surface 47" of tubing run 43". As plug 10" continues to move down due to pressure resulting from the setting operation, metal seal rings 75 are compressed causing their outer edges to move out into engagement with the wall surface 80 of tubing run 43" above surface 47". Continued movement causes the outer edges of seal rings 75 to be forced tightly against surface 80 while the inner edges of seal rings 75 are pressed tightly against the polished surface of wall 70 of locking unit 25" to seal off the space between plug 10" and tubing run 43". The effectiveness of the seal is then tested as described with respect to FIGS. 1 through 4. Although two seal rings 75 are shown, if desired, one or more than two seal rings 75 may be used.

Although annular seal member 30 of the embodiment of FIGS. 1 to 4 is shown and described as a replaceable seal member, such seal member may be formed integral with and part of locking unit 25. In that event there would be only one sealing surface (45) on the annular seal member.

Sealing material in the form of stainless steel rings may be bonded to sealing surfaces 47, 48, 80 and 70 to protect those surfaces from corrosion. Also, although the tubing plug is utilized herein with subsea equipment, other than subsea applications for the tubing plug are contemplated. Other changes and modifications may be made in the illustrative embodiments of the invention shown and/or described herein without departing from the scope of the invention as defined in the appended claims.

We claim:

1. A plug for use in sealing a tubing, said tubing having a locking recess and a tapered sealing surface formed on the inner wall thereof, said recess having a tapered surface, comprising:

first and second housings;

an inner mandrel connecting said first and second housings together for limited movement therebetween;

locking means on said first and second housings cooperating to lock said plug in said tubing recess when said first housing is moved relative to said second housing, said locking means on said first housing comprising a cone-shaped section and said locking means on said second housing comprising expansible-retractable lugs capable of being expanded by said cone-shaped section, said lugs having tapered surfaces for wedging against said tapered surface of said recess;

said second housing containing a tapered sealing surface and an annular metal seal means, said metal seal means having a first tapered sealing surface for sealing against said sealing surface on said tubing and a second tapered sealing surface for sealing against said sealing surface on said second housing to seal off the space between said tubing and said second housing, the distance between said tapered surfaces on said lugs and said first sealing surface on said metal seal means being precisely selected to ensure that said metal seal means is properly loaded for sealing when said plug is locked in said tubing recess.

2. A plug as recited in claim 1 including a closed end member connected to said second housing.

3. A plug as recited in claim 1 including a swivel connected to said second housing; and a diverter connected to said swivel.

4. A plug as recited in claim 1 including means for preloading said surfaces between said second sealing surface of said metal seal means and said sealing surface on said second housing.

5. A plug as recited in claim 1 in which said metal seal means comprises at least one sealing ring having inner and outer sealing edges.

6. A plug for use in sealing a tubing, said tubing having a locking recess and a tapered sealing surface formed on the inner wall thereof, said recess having a tapered surface, comprising:

a first tubular housing having a cone-shaped section;

a second tubular housing having a locking unit and a sealing unit;

an inner mandrel connecting said first and second housings for limited movement therebetween;

shear means initially connecting said mandrel and said first housing to prevent movement therebetween;

said locking unit including expansible lugs having tapered surfaces adapted to engage and wedge against said tapered surface of said locking recess;

said cone shaped section expanding said lugs to engage the tapered surfaces of said lugs and the tapered surface of said locking recess when said first housing is moved relative to said second housing;

said sealing unit containing a sealing surface and an annular metal seal means, said metal seal means containing first and second tapered sealing surfaces, said sealing surfaces on said tubing and said second housing being tapered, said first sealing surface being adapted to engage said tapered tubing sealing surface and said second sealing surface being adapted to engage said tapered sealing surface on said second housing; the distances between the tapered surfaces of said locking lugs and said second sealing surface of said metal seal means being precisely selected such that engaging and wedging the tapered surfaces of said lugs and tapered surface of said locking recess properly loads said seal means on the sealing surfaces of said tubing and said sealing unit.

7. A plug as recited in claim 6 including means for preloading said sealing surfaces between said second sealing surface of said metal seal means and said sealing surface on said second housing.

8. A plug as recited in claim 6 in which said metal seal means comprises at least one sealing ring having inner and outer sealing edges.

9. Apparatus comprising:

a tubing plug;

first and second tubular housings;

an inner mandrel connecting two housings together for limited movement therebetween;

said tubing having a locking recess and a shoulder formed on the inner wall thereof, said shoulder having a tapered surface;

locking means on said first and second housings cooperating to lock said plug in said recess when said first housing is moved relative to said second housing, said locking means on said first housing comprising a cone-shaped section and said locking means on said second housing comprising expansible-retractable lugs capable of being expanded by said cone-shaped section, said lugs having tapered surfaces engageable with said tapered surface of said recess; said second housing containing an annular metal seal means having tapered sealing surfaces which engage and seal against said sealing surface on said tubing and said sealing surface on said second housing to seal off the space between said tubing and said plug, the distance between said slanted surface on said locking recess and said slanted sealing surface on said tubing being precisely selected to ensure that said metal seal means is properly loaded for sealing when said locking means is locked in said tubing recess.

10. A plug as recited in claim 9 including a stop ledge formed on said tubing sealing surface to limit travel of said metal seal means.

* * * * *